US006681941B1

(12) United States Patent
Johnson

(10) Patent No.: US 6,681,941 B1
(45) Date of Patent: Jan. 27, 2004

(54) MULTI-PURPOSE STORING AND ORGANIZING ASSEMBLY

(76) Inventor: Kevin D. Johnson, 2747 Briarcliff Rd., Apt #6, Atlanta, GA (US) 30329

( * ) Notice: Subject to any disclaimer, the term of this patent is extended or adjusted under 35 U.S.C. 154(b) by 3 days.

(21) Appl. No.: 10/211,061

(22) Filed: Aug. 2, 2002

(51) Int. Cl.[7] ..... A47F 5/00

(52) U.S. Cl. ..... 211/86.01; 211/90.02; 211/90.04; 211/87.01; 211/105.1; 312/245

(58) Field of Search ..... 211/90.01, 90.02, 211/90.04, 87.01, 105.1, 105.3, 86.01; 312/245

(56) References Cited

U.S. PATENT DOCUMENTS

| | | | | |
|---|---|---|---|---|
| 2,492,226 A | | 12/1949 | Kohl et al. | |
| 2,598,614 A | | 5/1952 | Gilbert | |
| 3,081,881 A | | 3/1963 | Seeger | |
| 3,088,422 A | * | 5/1963 | Kaeslin | |
| D215,453 S | * | 9/1969 | Menne | |
| 3,538,842 A | * | 11/1970 | Labbato | |
| 3,705,653 A | | 12/1972 | Pereyra | |
| 4,206,955 A | * | 6/1980 | Cooper | |
| 4,324,076 A | * | 4/1982 | Honickman | |
| 4,688,687 A | * | 8/1987 | Pryor | 211/189 |
| D301,812 S | * | 6/1989 | Handler et al. | |
| 4,928,833 A | * | 5/1990 | Huizenga | 211/90.01 X |
| 5,191,986 A | * | 3/1993 | Huizenga | 211/87.01 X |
| 5,209,344 A | | 5/1993 | Smith | |
| D369,261 S | | 4/1996 | Brink | |
| 6,082,560 A | * | 7/2000 | Timm | 211/90.02 X |

* cited by examiner

*Primary Examiner*—Robert W. Gibson, Jr.

(57) ABSTRACT

A multi-purpose storing and organizing assembly for effectively storing items. The multi-purpose storing and organizing assembly includes a main member and a pair of side members. The main member has an open main front face, a pair of main side walls, a top end and a bottom end. A plurality shelves extend out from an inside surface of the main side walls. The shelves are spaced a predetermined distance away from each other. A pair of item holding members for hanging items on is coupled to an inside surface of the top end of the main member. Each side member has an open front side face. In addition, each side member has a connecting side. The connecting side of each side member is selectably attachable to an outside surface of an associated side wall of the main member. Moreover, each side member includes a top compartment for storing items.

20 Claims, 4 Drawing Sheets

MULTI-PURPOSE STORING AND ORGANIZING ASSEMBLY

BACKGROUND OF THE INVENTION

1. Field of the Invention

The present invention relates to item storing devices and more particularly pertains to a new multi-purpose storing and organizing assembly for effectively storing items.

2. Description of the Prior Art

The use of item storing devices is known in the prior art. More specifically, item storing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,081,881; U.S. Pat. No. 2,598,614; U.S. Pat. No. 2,492,226; U.S. Pat. No. 3,705,653; U.S. Pat. No. 5,209,344; and U.S. Pat. No. Des. 369,261.

While these devices fulfill their respective, particular objectives and requirements, the aforementioned patents do not disclose a new multi-purpose storing and organizing assembly. The inventive device includes a main member and a pair of side members. The main member has an open main front face, a pair of main side walls, a top end and a bottom end. A plurality shelves extend out from an inside surface of the main side walls. The shelves are spaced a predetermined distance away from each other. A pair of item holding members for hanging items on is coupled to an inside surface of the top end of the main member. Each side member has an open front side face. In addition, each side member has a connecting side. The connecting side of each side member is selectably attachable to an outside surface of an associated side wall of the main member. Moreover, each side member includes a top compartment for storing items.

In these respects, the multi-purpose storing and organizing assembly according to the present invention substantially departs from the conventional concepts and designs of the prior art, and in so doing provides an apparatus primarily developed for the purpose of effectively storing items.

SUMMARY OF THE INVENTION

In view of the foregoing disadvantages inherent in the known types of item storing devices now present in the prior art, the present invention provides a new multi-purpose storing and organizing assembly construction wherein the same can be utilized for effectively storing items.

The general purpose of the present invention, which will be described subsequently in greater detail, is to provide a new multi-purpose storing and organizing assembly apparatus and method which has many of the advantages of the item storing devices mentioned heretofore and many novel features that result in a new multi-purpose storing and organizing assembly which is not anticipated, rendered obvious, suggested, or even implied by any of the prior art item storing devices, either alone or in any combination thereof.

To attain this, the present invention generally comprises a main member and a pair of side members. The main member has an open main front face, a pair of main side walls, a top end and a bottom end. A plurality shelves extend out from an inside surface of the main side walls. The shelves are spaced a predetermined distance away from each other. A pair of item holding members for hanging items on is coupled to an inside surface of the top end of the main member. Each side member has an open front side face. In addition, each side member has a connecting side. The connecting side of each side member is selectably attachable to an outside surface of an associated side wall of the main member. Moreover, each side member includes a top compartment for storing items.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multi-purpose storing and organizing assembly apparatus and method which has many of the advantages of the item storing devices mentioned heretofore and many novel features that result in a new multi-purpose storing and organizing assembly which is not anticipated, rendered obvious, suggested, or even implied by any of the prior art item storing devices, either alone or in any combination thereof.

It is another object of the present invention to provide a new multi-purpose storing and organizing assembly which may be easily and efficiently manufactured and marketed.

It is a further object of the present invention to provide a new multi-purpose storing and organizing assembly which is of a durable and reliable construction.

An even further object of the present invention is to provide a new multi-purpose storing and organizing assembly which is susceptible of a low cost of manufacture with regard to both materials and labor, and which accordingly is then susceptible of low prices of sale to the consuming public, thereby making such multi-purpose storing and organizing assembly economically available to the buying public.

Still yet another object of the present invention is to provide a new multi-purpose storing and organizing assembly which provides in the apparatuses and methods of the prior art some of the advantages thereof, while simultaneously overcoming some of the disadvantages normally associated therewith.

Still another object of the present invention is to provide a new multi-purpose storing and organizing assembly for effectively storing items.

Yet another object of the present invention is to provide a new multi-purpose storing and organizing assembly which includes a main member and a pair of side members. The main member has an open main front face, a pair of main side walls, a top end and a bottom end. A plurality shelves extend out from an inside surface of the main side walls. The shelves are spaced a predetermined distance away from each other. A pair of item holding members for hanging items on is coupled to an inside surface of the top end of the main member. Each side member has an open front side face. In addition, each side member has a connecting side. The connecting side of each side member is selectably attachable to an outside surface of an associated side wall of the main member. Moreover, each side member includes a top compartment for storing items.

Still yet another object of the present invention is to provide a new multi-purpose storing and organizing assembly that can be packed for travel.

Even still another object of the present invention is to provide a new multi-purpose storing and organizing assembly that stores and secures items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
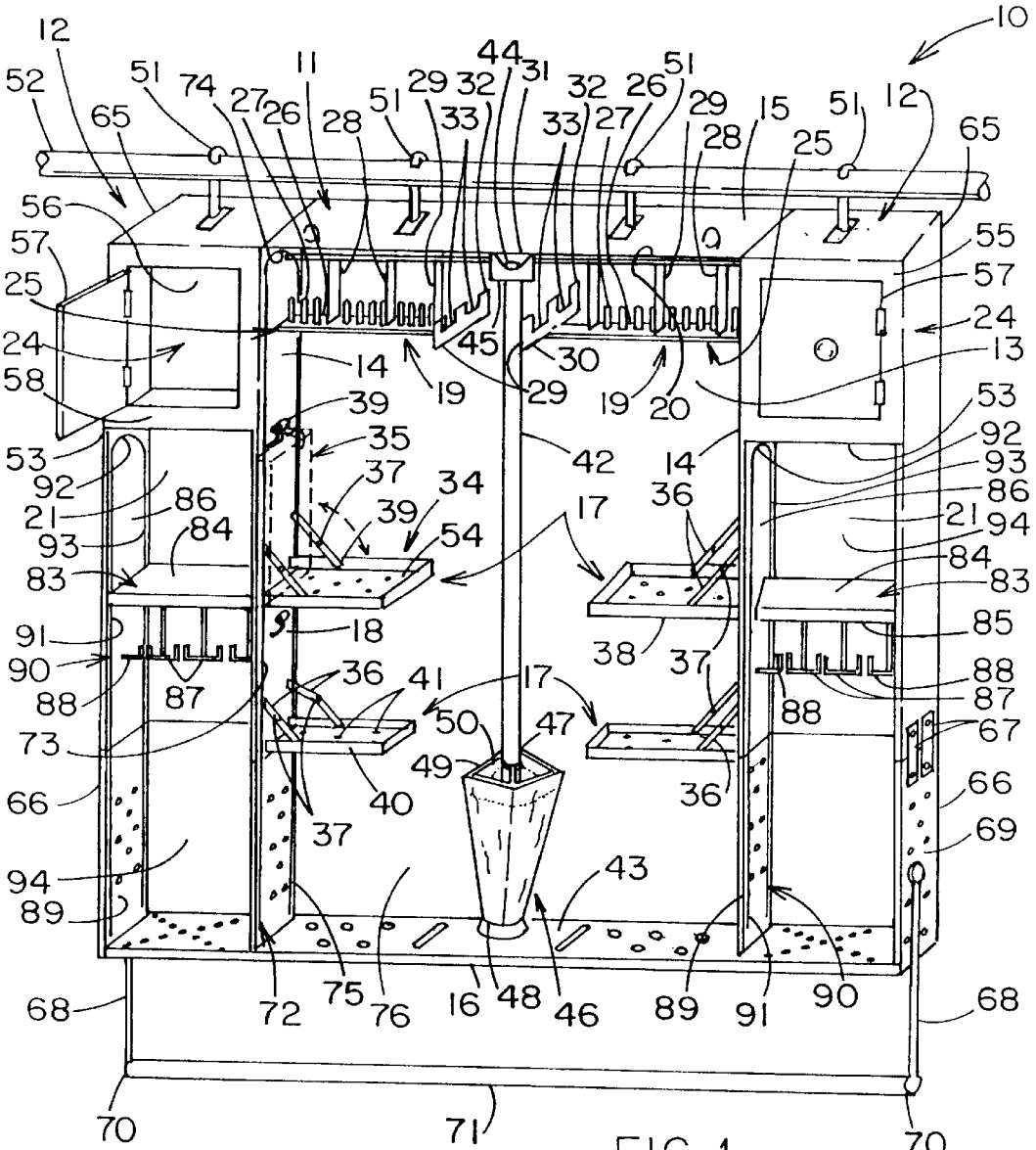
FIG. 1 is a schematic perspective view of a new multi-purpose storing and organizing assembly according to the present invention.
Figure 2:
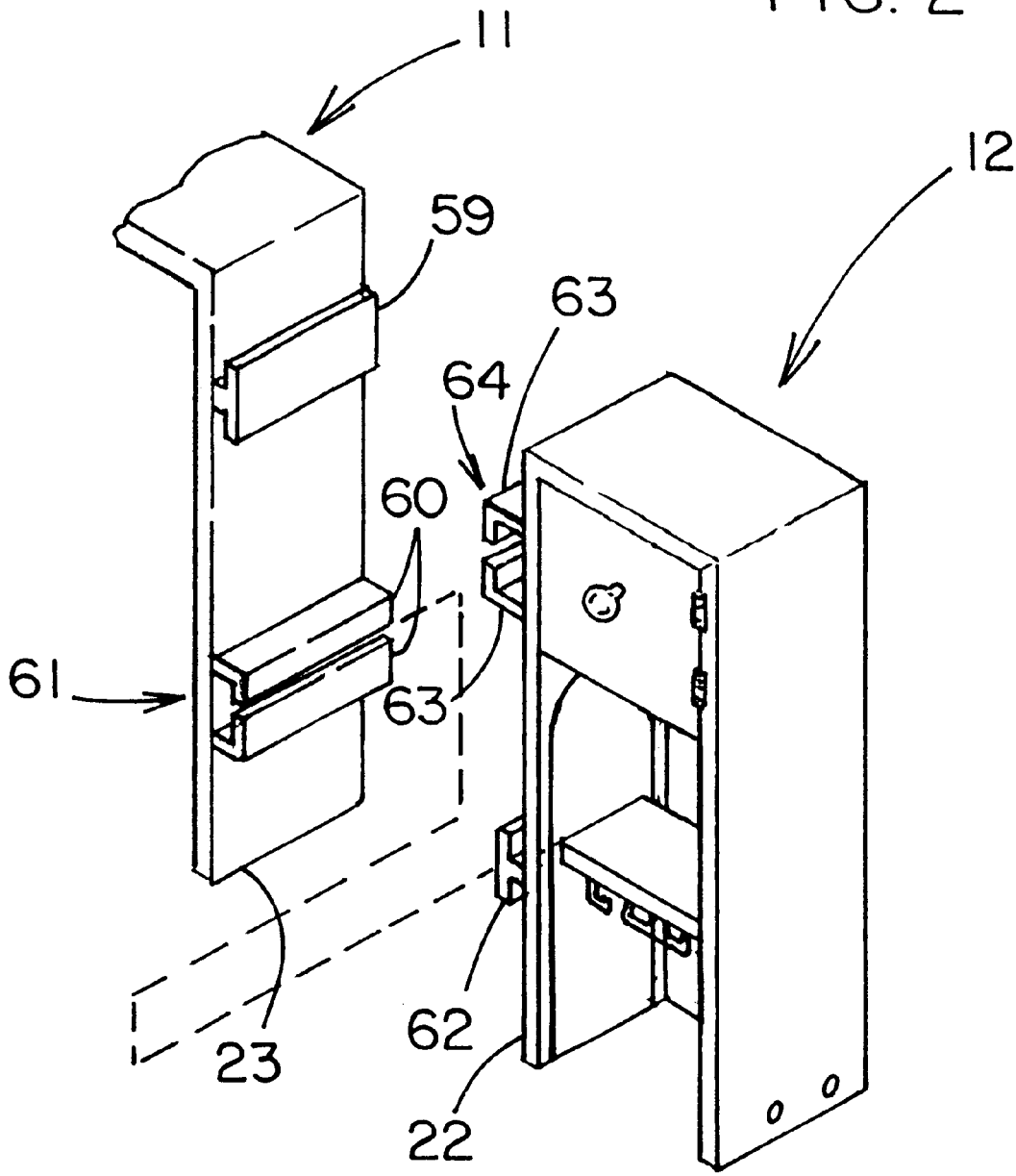
FIG. 2 is a schematic perspective view of the present invention illustrating how the side members are connected to the main member.
Figure 3:
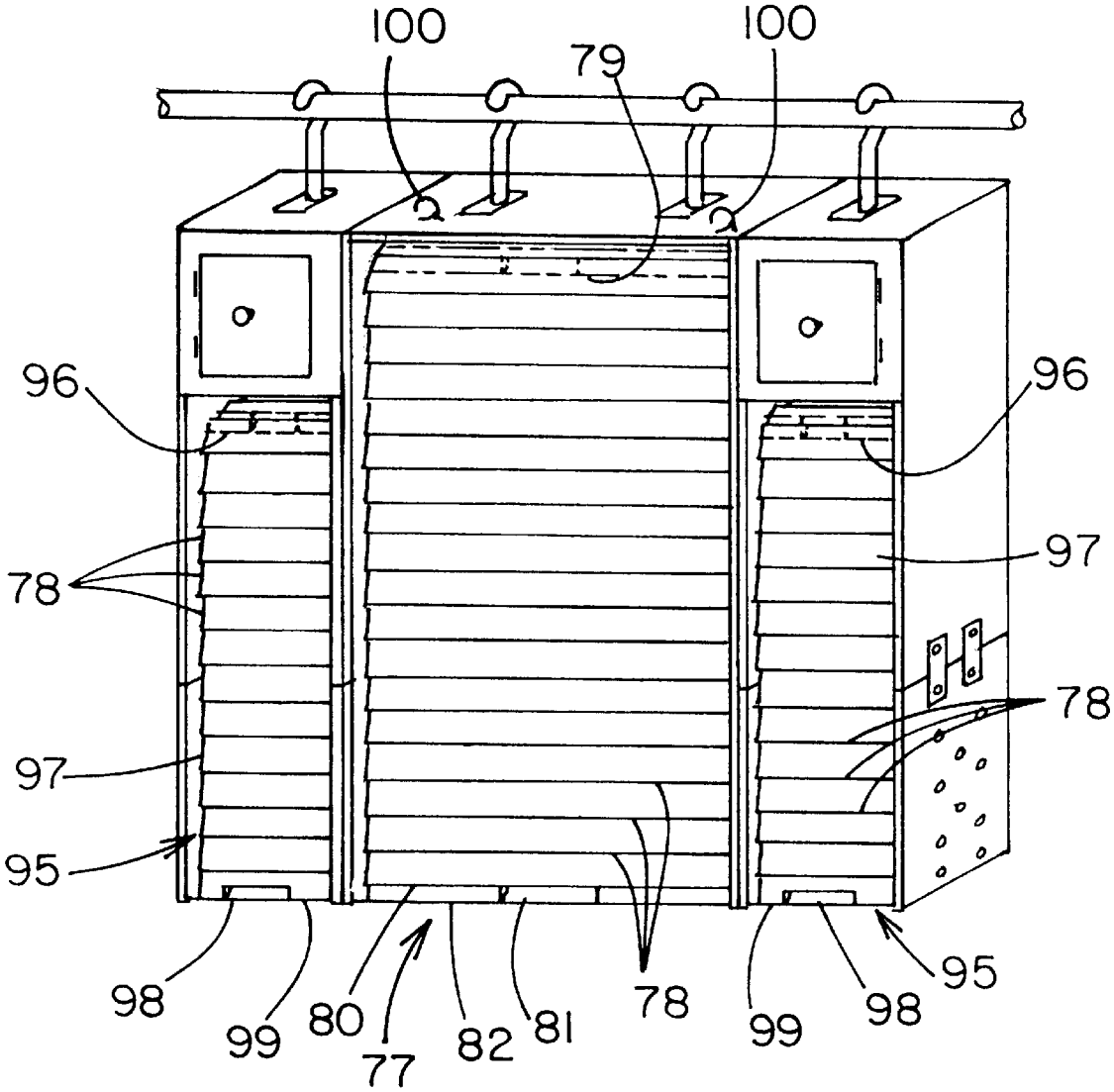
FIG. 3 is a schematic perspective view of the present invention with the rollup doors in their respective closed positions.
Figure 4:
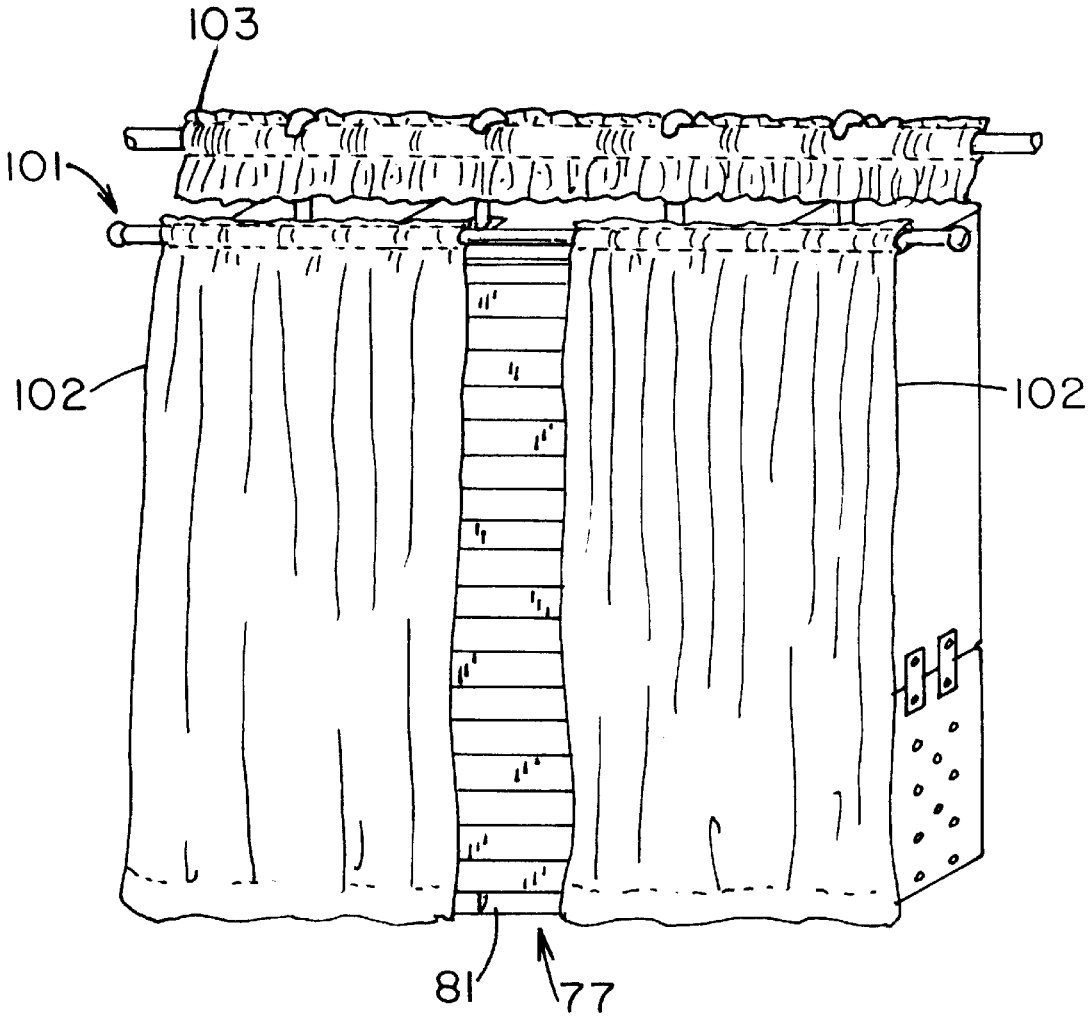
FIG. 4 is a schematic perspective view of the present invention illustrating the use of a curtain to hide a new multi-purpose storing and organizing assembly.

With reference now to the drawings, and in particular to FIGS. 1 through 4 thereof, a new multi-purpose storing and organizing assembly embodying the principles and concepts of the present invention and generally designated by the reference numeral 10 will be described.

As best illustrated in FIGS. 1 through 4, the multi-purpose storing and organizing assembly 10 generally comprises a main member 11 and a pair of side members 12. The main member 11 is generally rectangular box shaped. Moreover, the main member 11 has an open main front face 13, a pair of main side walls 14, a top end 15 and a bottom end 16. A plurality shelves 17 extend out from an inside surface 18 of the main side walls 14. The shelves 17 are spaced a predetermined distance away from each other. A pair of item holding members 19 for hanging items on is coupled to an inside surface 20 of the top end 15 of the main member 11. Each side member 12 has an open front side face 21. In addition, each side member 12 has a connecting side 22. The connecting side 22 of each side member 12 is selectably attachable to an outside surface 23 of an associated main side wall 14 of the main member 11. Moreover, each side member 12 includes a top compartment 24 for storing items.

In closer detail, each said item holding member 19 includes an elongated platform 25. The platform 25 has an upper surface 26. A plurality of pegs 27 for hanging items on extend from the upper surface 26 of the platform 25. A plurality of connecting rods 28 are used to couple the platform 25 to the main member 1. The connecting rods 28 are coupled between the upper surface 26 of the platform 26 and the inside surface 20 of the top end 15 of the main member 11. In addition, an end holding portion 29 for hanging items on is coupled to a distal end 30 of the platform 25 proximate a medial portion 31 of the main member 11. The end holding portion 29 has a top end 32 that has a plurality of cutout portions 33 for facilitating the hanging of items.

The shelves 17 are pivotally coupled to the inside surface 18 of the main side walls 14. The shelves 17 have an open position 34 and a stored position 35. The open position 34 is defined when said shelves 17 extend generally perpendicular from the inside surface 18 of the main side walls 14. The stored position 35 is defined when the shelves 17 are pivotally rotated adjacent the inside surface 18 of the main side walls 14.

A plurality of holding arms 36 are used for holding the shelves 17 in the open position 34. Each said holding arm 36 has a medial pivot 37 for allowing the holding arm 36 to fold together. A pair of the holding arms 36 are coupled between the inside surface 18 of the main side walls 14 and a medial portion 38 of each shelf 17. A plurality of shelf latches 39 are used to selectively hold an associated shelf 17 in its closed position 35. The shelves latches 39 are rotatably coupled to the inside surface 18 of the main side wall 14 proximate an associated shelf 17 when the shelf 17 in its closed position 35.

In addition, the shelves 17 have a vertical ridge portion 40 that extends around a perimeter of each shelf 17 for holding items placed on the shelf 17. Moreover, each shelf has a bottom end 54 that has a plurality of apertures 41 for allowing ventilation of the items placed on the shelves 17.

A center rod 42 is coupled between the inside surface 20 of the top end of the main member 11 and an inside surface 43 of the bottom end 16 of the main member 11. The center rod 42 is further positioned to extend along the medial portion 31 of the main member 11. Moreover, an upper portion 44 of the center rod 42 is selectably coupled in a center rod holding portion 45. The center rod holding portion 45 is coupled to the inside surface 20 of the top end 15 of the main member 11 along the medial portion 31 of the main member 11.

A generally frusto-conical sock holding portion 46 is received around a bottom portion 47 of the center rod 42.

The sock holding portion 46 has a first end 48 that is coupled to the inside surface 43 of the bottom end 16 of the main member 11. The sock holding portion 46 has an open second end 49 that is designed for receiving items to be stored. The sock holding portion 46 further has a plurality of partitions 50 for separating the items to be stored. Moreover, the sock holding portion 46 is constructed of a flexible substantially elastic material that is designed to facilitate the holding of items to be stored.

The bottom end 16 of the main member 11 has a plurality of apertures 41 for providing ventilation of the main member 11. Moreover, the side walls 14 of the main member 11 has a plurality of apertures 41 for providing ventilation to the main member 11. In addition a plurality of connecting hooks 51 are used to connect the main member 11 to a horizontal rod 52. The connecting hooks 51 are coupled to the top end 15 of the main member 11.

Each side member 12 is generally rectangular box shaped. Each side member 12 has a height that is generally equal to a height of the main member 1. Each said side member 12 also has a depth that is generally equal to a depth of the main member. Each side member 12 further has a width that is generally less than the width of the main member 11.

The top compartment 24 of each side member 12 is generally box shaped and is positioned proximate a top end 53 of the side member 12. The top compartment 24 further has a front side 55 that has an opening 56 to the top compartment 24. The top compartment 24 further has a door 57 for selectively covering the opening 56 to the top compartment 24. The door 57 is hingably coupled to a framing portion 58 of the front side 55 of the top compartment 24.

Each outside surface 23 of the side wall 14 of the main member 11 has a first T-shaped connecting portion 59 extending horizontally along the depth of the main member 11. In addition, each outside surface 23 of the side wall 14 of said main member 11 has a pair of L-shaped portions 60. Each L-shaped portion 60 extends horizontally along the depth of the main member 11. Each L-shaped portion 60 is spaced a predetermined distance from each other. The L-shaped portions 60 form a first receiving bracket 61. The first receiving bracket 61 is positioned a predetermined distance from the first T-shaped connecting portion 59.

Each connecting side 22 of each side member 12 has a second T-shaped connecting portion 62 extending horizontally along the depth of the side member 12. The second T-shaped connecting portion is 62 designed to be selectably attachable to the first receiving bracket 61 on an associated side wall 14 of the main member 11.

Each connecting side 22 of each side member 12 further has a pair of L-shaped portions 63. Each L-shaped portion 63 extends horizontally along the depth of the side member 12. Each L-shaped portion 63 is spaced a predetermined distance from each other. The L-shaped portions 63, form a second receiving bracket 64. The second receiving bracket 64 is positioned a predetermined distance from the second T-shaped connecting portion 62. The second receiving bracket 64 is further designed to be selectably attachable to the first T-shaped connecting portion 59 on an associated side wall 14 of the main member 11.

Each side member 12 further has at least one connecting hook 51 for connecting the side member 12 to the horizontal rod 52. The connecting hook 51 is coupled to a top end 65 of the side member 12. Each side member 12 further has a bottom portion 66. The bottom portion 66 selectably extends from the side member 12. Each bottom portion 66 is selectably coupled to an associated side member 12 by a clamp 67. In addition, the bottom portion 66 of each side member 12 has a plurality of apertures 41 for allowing ventilation of the side member 12.

Each side member 12 further has a pair of side member walls 89. Each side member wall 89 has an inside surface 86. Each side member 12 includes at least one side shelf 83. The self 83 has a top surface 84 for storing items on. The side shelf 83 further has a bottom surface 85. The side self 83 is coupled between the inside surfaces 86 of the side member walls 89 of the side member 12. A plurality of shelf hooks 87 for hanging items on extends from the bottom surface 85 of the side shelf 83. A plurality of side hooks 88 for hanging items on extends from the inside surface 86 of the side member walls 89.

The multi-purpose storing and organizing assembly 10 also has a pair of vertical connecting rods 68. Each connecting rod 68 extends from an outside surface 69 of an associated bottom portion 66 of an associated side member 12. Each connecting rod 68 further has a distal end 70. A horizontal hanging pole 71 for hanging items is coupled between the distal ends 70 of the connecting rods 68.

The inside surfaces 18 of each said main side wall 14 has a main track 72. Each main track 72 has vertical front portion 73 proximate the main front face 13. Each main track 72 also has a U-shaped medial portion 74 that is proximate the top end 15 of the main member 11. Each main track 72 further has a vertical back portion 75 that is proximate a back side 76 of the main member 11. A main rollup door 77 is used for selectively covering the main front face 13 of the main member 11. The main rollup door 77 includes a plurality of panels 78. The panels 78 are pivotally coupled to each other to allow the main rollup door 77 to bend. The main rollup door 77 is slidably received in the main tracks 72 in the main member 11.

The main rollup door 77 has an open position 79 and a closed position 80. The open position 79 is defined when the main rollup door 77 is slidably positioned in the back portion 75 of the main tracks 72 thereby allowing the main front face 13 of the main member 11 to be unobstructed. The closed position 80 is defined when the main rollup door 77 is slidably positioned in the front portion 73 of the main track 72 thereby causing the main front face 13 of the main member 11 to be obstructed. A main handle 81 is used for maneuvering the main rollup door 77. The main handle 81 is coupled to the main rollup door 77 proximate a bottom edge 82 of the main rollup door 77.

Each inside surface 86 of each side member wall 89 of each side member 12 has a side track 90. Each side track 90 has vertical front portion 91 proximate the front side face 21 of the side member 12. Each side track 90 also has a U-shaped medial portion 92 proximate the top compartment 24 of each side member 12. Each side track 90 further has a vertical back portion 93 proximate a back side 94 of the side member 12.

A pair of side rollup doors 95 are used for selectively covering the front side face 21 of an associated side member 12. Each side rollup door 95 includes a plurality of panels 78. The panels 78 are pivotally coupled to each other wherein each side rollup door 95 is bendable. Each side rollup door 95 is slidably received in the side tracks 90 in an associated side member 12.

Each side rollup door 95 has an open position 96 and a closed position 97. The open position 96 is defined when the side rollup door 95 is slidably positioned in the back portion 93 of the side track 90 thereby allowing the front side face 21 of the side member 12 to be unobstructed. The closed position 97 is defined when the side rollup door 95 is slidably positioned in the front portion 91 of the side track 90 thereby obstructing the front side face 21 of each side member 12. In addition, a pair of side handles 98 are used to maneuver the side rollup doors 95. Each side handle 98 is coupled to an associated side rollup door 95 proximate a bottom edge 99 of the side rollup door 95.

A plurality of curtain rod hooks 100 are used for holding a curtain rod 101. The curtain rod hooks 100 are coupled to the top end 15 of the main member 11 proximate the main front face 13 of the main member 11. Each curtain rod hook 100 is spaced a predetermined distance apart from each other. The curtain rod 101 is removably coupled to the curtain rod hooks 100. A curtain 102 may be used to cover the main member 11 and the side members 12. The curtain 102 is slidably coupled to the curtain rod 101. Thus the curtain 102 can be slid to cover and uncover the main member 11 and the side members 12.

In addition, a rod treatment curtain 103 may be used for covering the horizontal rod 52 and connecting hooks 51. The rod treatment curtain 104 is coupled to the horizontal rod 52 proximate the connecting hooks 51.

In use, the side members 12 are coupled to the main member 11. The main rollup door 77 is placed in its open position 79. The side rollup doors 95 are then positioned in their open position 96. Items may then be placed in the multi-purpose storing and organizing assembly 10. When finished, the main rollup door 77 is placed in its closed position 80. The side rollup doors 95 are also placed in their closed position 97. The multi-purpose storing and organizing assembly 10 may then be hung on a horizontal rod 52 by the connecting hooks 51 for storage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multi-purpose storing and organizing assembly comprising:

a main member having an open main front face, said main member having a pair of main side walls, said main member further having a top end and a bottom end;

a plurality shelves for holding items, said shelves extending out from an inside surface of said main side walls, said shelves being spaced a predetermined distance away from each other;

a pair of item holding members for hanging items on, each said item holding member being coupled to an inside surface of said top end of said main member;

a pair of side members having an open front side face, each said side member having a connecting side, said connecting side of each said side member being selectably attachable to an outside surface of an associated said side wall of said main member; and each said side member including a top compartment for storing items said top compartment being positioned proximate a top end of said side member, said top compartment having a front side, said front side having an opening to said top compartment.

2. The multi-purpose storing and organizing assembly of claim 1 further comprising:

said shelves being pivotally coupled to said inside surface of said main side walls, said shelves having an open position and a stored position, said open position being defined when said shelves extend generally perpendicular from said inside surface of said main side walls, said stored position being defined when said shelves are pivotally rotated adjacent said inside surface of said main side walls;

a plurality of holding arms for holding said shelves in said open position, each said holding arm having a medial pivot for allowing said holding arm to fold together, a pair of said holding arms being coupled between said inside surface of said main side walls and a medial portion of each said shelf; and a plurality of shelf latches, each said shelf latch being adapted to hold an associated shelf in said closed position.

3. The multi-purpose storing and organizing assembly of claim 1 further comprising:

each said shelf having a vertical ridge portion extending around a perimeter of said shelf for holding items placed on said shelves.

4. The multi-purpose storing and organizing assembly of claim 1 further comprising:

each said shelf having a bottom end, said bottom end having a plurality of apertures for allowing ventilation of said items placed on said shelf.

5. The multi-purpose storing and organizing assembly of claim 1 wherein each said item holding member further comprising:

an elongated platform, said platform having a upper surface;

a plurality of pegs for hanging items on, said pegs extending from said upper surface of said platform;

a plurality of connecting rods for coupling said platform to said main member, said connecting rods being coupled between said upper surface of said platform and an inside surface of said top end of said main member; and an end holding portion for hanging items on, said end holding portion being coupled to a distal end of said platform proximate a medial portion of said main member, said end holding portion having a top end, said top end of said end holding portion having a plurality of cutout portions for facilitating the hanging of items.

6. The multi-purpose storing and organizing assembly of claim 1 further comprising:

a center rod said center rod being coupled between said inside surface of said top end of said main member and an inside surface of said bottom end of said main member, said center rod further extending along a medial portion of said main member;

a generally frusto-conical sock holding portion, said sock holding portion being received around a bottom portion of said center rod, said sock holding portion having a first end coupled to said inside surface of said bottom end of said main member; said sock holding portion having a open second end adapted for insertion of items to be stored, said sock holding portion further having a plurality of partitions for separating said items; and said sock holding portion being constructed of a flexible substantially elastic material.

7. The multi-purpose storing and organizing assembly of claim 1 further comprising:

said bottom end of said main member having a plurality of apertures for providing ventilation of said main member; and said side walls of said main member having a plurality of apertures for providing ventilation to said main member.

8. The multi-purpose storing and organizing assembly of claim 1 further comprising:

a plurality of connecting hooks for connecting said main member to a horizontal rod, said connecting hooks being coupled to said top end of said main member.

9. The multi-purpose storing and organizing assembly of claim 1 further comprising:

each side member being generally rectangular box shaped, each said side member having a height generally equal to a height of said main member, each said side member also having a depth generally equal to a depth of said main member, each side member further having a width generally less than the width of said main member.

10. The multi-purpose storing and organizing assembly of claim 9 further comprising:

each said outside surface of said side wall of said main member having a first T-shaped connecting portion extending horizontally along said depth of said main member;

each said outside surface of said side wall of said main member further having a pair of L-shaped portions, each said L-shaped portions extending horizontally along said depth of said main member each said L-shaped portions being spaced a predetermined distance from each other, said L-shaped portions forming a first receiving bracket, said first receiving bracket being positioned a predetermined distance from said first T-shaped connecting portion;

each said connecting side of each said side member having a second T-shaped connecting portion extending horizontally along said depth of said side member, said second T-shaped connecting portion further being adapted to be selectably attachable to said first receiving bracket on an associated said side wall of said main member; and each said connecting side of each said side member further having a pair of L-shaped portions, each said L-shaped portions extending horizontally along said depth of said side member, each said L-shaped portions being spaced a predetermined distance from each other, said L-shaped portions forming a second receiving bracket, said second receiving bracket being positioned a predetermined distance from said second T-shaped connecting portion, said second receiving bracket further being adapted to be selectably attachable to said first T-shaped connecting portion on an associated said side wall of said main member.

11. The multi-purpose storing and organizing assembly of claim 1 further comprising:

each said side member further having at least one connecting hook for connecting said side member to a horizontal rod, said connecting hook being coupled to a top end of said side member.

12. The multi-purpose storing and organizing assembly of claim 1 wherein each side member further comprising:

each said side member having a pair of side member walls, each side member wall having an inside surface;

at least one side shelf, said side shelf having a top surface for storing items on, said side shelf further having a bottom surface, said side shelf being coupled between said inside surfaces of said side member walls;

a plurality of shelf hooks for hanging items on, said shelf hooks extending from said bottom surface of said side shelf; and a plurality of side hooks for hanging items, said side hooks extending from said inner surface of said side member; and a door for selectively covering said opening to said top compartment, said door being hingably coupled to a framing portion of said front side of said top compartment.

13. The multi-purpose storing and organizing assembly of claim 1 further comprising:

each side member further having a bottom portion, said bottom portion selectably extending from said side member, each said bottom portion being selectably coupled to an associated said side member by a clamp; and said bottom portion of each said side member having a plurality of apertures for allowing ventilation of said side member.

14. The multi-purpose storing and organizing assembly of claim 13 further comprising:

a pair of vertical connecting rods, each said connecting rod extending from an outside surface of an associated said bottom portion of an associated said side member, each said connecting rod further having a distal end, and a horizontal hanging pole for hanging items, said horizontal hanging pole being coupled between said distal ends of said connecting rods.

15. The multi-purpose storing and organizing assembly of claim 1 further comprising:

said inside surfaces of each said main side wall having a main track, each said main track having vertical front portion proximate said main front face, each said main track also having a U-shaped medial portion proximate said top end of said main member, each said main track further having a vertical back portion proximate a back side of said main member;

a main rollup door for selectively covering said main front face of said main member, said main rollup door including a plurality of panels, said panels being pivotally coupled to each other wherein said main rollup door may bend, said main rollup door being slidably received in said main tracks in said main member;

said main rollup door having an open position and a closed position, said open position being defined when said main rollup door is slidably positioned in said back portion of said main track wherein said main front face of said main member is unobstructed, said closed position being defined when said main rollup door is slidably positioned in said front portion of said main track wherein said main front face of said main member is obstructed; and a main handle for maneuvering said main rollup door, said main handle being coupled to said main rollup door proximate a bottom edge of said main rollup door.

16. The multi-purpose storing and organizing assembly of claim 1 further comprising:

each said side member having a pair of side member walls, each side member wall having an inside surface;

each inside surface of each said side member wall having a side track, each said side track having vertical front portion proximate said front side face, each said side track also having a U-shaped medial portion proximate said top compartment of each said side member, each said side track further having a vertical back portion proximate a back side of said side member;

a pair of side rollup doors for selectively covering said front side face of an associated said side member, said side rollup door including a plurality of panels, said panels being pivotally coupled to each other wherein each said side rollup door is bendable, each said side rollup door being slidably received in said side tracks in an associated side member;

each said side rollup door having an open position and a closed position, said open position being defined when said side rollup door is slidably positioned in said back portion of said side track wherein said front side face of said side member is unobstructed, said closed position being defined when said side rollup door is slidably positioned in said front portion of said side track wherein said side rollup door obstructs said front side face of said side member; and a pair of side handles for maneuvering said side rollup doors, each said side handle being coupled to an associated said side rollup door proximate a bottom edge of said side rollup door.

17. The multi-purpose storing and organizing assembly of claim 8 further comprising:

a plurality of curtain rod hooks for holding a curtain rod, said curtain rod hooks being coupled to said top end of said main member proximate said main front face of said main member, each said curtain rod hook being spaced a predetermined distance apart from another said curtain rod hook;

a curtain rod adapted to be removably coupled to said curtain rod hooks, said curtain rod being removably coupled to said curtain rod hooks;

a curtain for covering said main member and said side members said curtain being slidably coupled to said curtain rod wherein said curtain can be slid to cover and uncover said main member and said side members; and a rod treatment curtain for covering said horizontal rod and connecting hooks, said rod treatment being coupled to said horizontal rod proximate said connecting hooks.

18. The multi-purpose storing and organizing assembly of claim 1 further comprising:

said main member being generally rectangular box shaped.

19. The multi-purpose storing and organizing assembly of claim 1 further comprising:

said top compartment of said side members being box shaped.

20. A multi-purpose storing and organizing assembly comprising:

a main member, said main member being generally rectangular box shaped having an open front face, said main member having a pair of main side walls, said main member further having a top end and a bottom end;

a plurality shelves for holding items, said shelves extending out from an inside surface of said main side walls, said shelves being spaced a predetermined distance away from each other;

said shelves being pivotally coupled to said inside surface of said main side walls, said shelves having an open position and a stored position, said open position being defined when said shelves extend generally perpendicular from said inside surface of said main side walls, said stored position being defined when said shelves are pivotally rotated adjacent said inside surface of said main side walls;

a plurality of holding arms for holding said shelves in said open position, each said holding arm having a medial pivot for allowing said holding arm to fold together, a pair of said holding arms being coupled between said inside surface of said main side walls and a medial portion of each said shelves wherein each shelve is held in said open position by a pair of said holding arms;

a plurality of shelf latches, each said shelf latch being adapted to hold an associated shelf in said closed position;

each said shelf having a vertical ridge portion extending around a perimeter of said shelf for holding items placed on said shelf;

each said shelf having a bottom end, said bottom end having a plurality of apertures for allowing ventilation of said items placed on said shelf;

a pair of item holding members, each said item holding member including an elongated platform, said platform having a upper surface;

a plurality of pegs for hanging items on, said pegs extending from said upper surface of said platform;

a plurality of connecting rods for coupling said platform to said main member, said connecting rods being coupled between said upper surface of said platform and an inside surface of said top end of said main member;

an end holding portion for hanging items on, said end holding portion being coupled generally perpendicular to a distal end of said platform proximate a medial portion of said main member, said end holding portion having a top end, said top end of said end holding portion having a plurality of cutout portions for facilitating the hanging of items;

a center rod; said center rod being coupled between said inside surface of said top end of said main member and an inside surface of said bottom end of said main member, said center rod further extending along said medial portion of said main member;

a generally frusto-conical sock holding portion, said sock holding portion being received around said center rod, said sock holding portion having a first end coupled to said inside surface of said bottom end of said main member; said sock holding portion having a open second end adapted for insertion of items to be stored, said sock holding portion further having a plurality of partitions for separating said items;

said sock holding portion being constructed of a flexible substantially elastic material;

said bottom end of said main member having a plurality of apertures for providing ventilation of said main member;

said side walls of said main member having a plurality of apertures for providing ventilation to said main member;

a plurality of connecting hooks for connecting said main member to a horizontal rod, said connecting hooks being coupled to said top end of said main member;

a pair of side members, each side member being generally rectangular box shaped having an open front side face, each said side member having a height generally equal to a height of said main member, each said side member also having a depth generally equal to a depth of said main member, each side member further having a width generally less than the width of said main member, each said side member having a connecting side, said connecting side of each said side member being selectably attached to an outside surface of an associated said side wall of said main member;

each said outside surface of said side wall of said main member having a first T-shaped connecting portion extending horizontally along said depth of said main member;

each said outside surface of said side wall of said main member further having a pair of L-shaped portions, each said L-shaped portions extending horizontally along said depth of said main member, each said L-shaped portions being spaced a predetermined distance from each other, said L-shaped portions forming a first receiving bracket, said first receiving bracket being positioned a predetermined distance from said first T-shaped connecting portion;

each said connecting side of each said side member having a second T-shaped connecting portion extending horizontally along said depth of said side member, said second T-shaped connecting portion further being adapted to be selectably attachable to said first receiving bracket on an associated said side wall of said main member;

each said connecting side of each said side member further having a pair of L-shaped portions, each said L-shaped portions extending horizontally along said depth of said side member, each said L-shaped portions being spaced a predetermined distance from each other, said L-shaped portions forming a second receiving bracket, said second receiving bracket being positioned a predetermined distance from said second T-shaped connecting portion, said second receiving bracket further being adapted to be selectably attachable to said first T-shaped connecting portion on an associated said side wall of said main member;

each said side member further having at least one connecting hook for connecting said side member to a horizontal rod, said connecting hook being coupled to a top end of said side member;

each said side member further including a generally box shaped top compartment for storing items, said top compartment being positioned proximate a top end of said side member, said top compartment having a front side, said front side having an opening to said top compartment, said top compartment further having a door for selectively covering said opening to said top compartment, said door being hingably coupled to a framing portion of said front side of said top compartment;

each said side member having a pair of side member walls, each side member wall having an inside surface;

at least one side shelf, said side shelf having a top surface for storing items on, said side shelf further having a bottom surface, said side shelf being coupled between said inside surfaces of said side member walls;

a plurality of shelf hooks for hanging items on, said shelf hooks extending from said bottom surface of said side shelf;

a plurality of side hooks for hanging items, said side hooks extending from said inside surface of said side member walls;

each side member further having a bottom portion, said bottom portion selectably extending from said side member, each said bottom portion being selectably coupled to an associated said side member by a clamp;

said bottom portion of each said side member having a plurality of apertures for allowing ventilation of said side member;

a pair of vertical connecting rods, each said connecting rod extending from an outside surface of an associated said bottom portion of an associated said side member, each said connecting rod further having a distal end;

a horizontal hanging pole for hanging items, said horizontal hanging pole being coupled between said distal ends of said connecting rods;

said inside surfaces of each said main side wall having a main track, each said main track having vertical front portion proximate said main front face, each said main track also having a U-shaped medial portion proximate said top end of said main member, each said main track further having a vertical back portion proximate a back side of said main member;

a main rollup door for selectively covering said main front face of said main member, said main rollup door including a plurality of panels, said panels being pivotally coupled to each other wherein said main rollup door is bendable, said main rollup door being slidably received in said main tracks in said main member;

said main rollup door having an open position and a closed position, said open position being defined when said main rollup door is slidably positioned in said back portion of said main track wherein said main front face of said main member is unobstructed, said closed position being defined when said main rollup door is slidably positioned in said front portion of said main track wherein said main front face of said main member is obstructed;

a main handle for maneuvering said main rollup door, said main handle being coupled to said main rollup door proximate a bottom edge of said main rollup door;

each said inside surface of each said side member wall having a side track, each said side track having vertical front portion proximate said front side face, each said side track also having a U-shaped medial portion proximate said top compartment of each said side member, each said side track further having a vertical back portion proximate a back side of said side member;

a pair of side rollup doors for selectively covering said front side face of an associated said side member, each said side rollup door including a plurality of panels, said panels being pivotally coupled to each other wherein each said side rollup door is bendable, each said side rollup door being slidably received in said side tracks in an associated side member;

each said side rollup door having an open position and a closed position, said open position being defined when said side rollup door is slidably positioned in said back portion of said side track wherein said front side face of said side member is unobstructed, said closed position being defined when said side rollup door is slidably positioned in said front portion of said side track wherein said side rollup door obstructs said front side face of said side member;

a pair of side handles for maneuvering said side rollup doors, each said side handle being coupled to an associated said side rollup door proximate a bottom edge of said side rollup door;

a plurality of curtain rod hooks for holding a curtain rod, said curtain rod hooks being coupled to said top end of said main member proximate said main front face of said main member, each said curtain rod hook being spaced a predetermined distance apart from another said curtain rod hook;

a curtain rod adapted to be removably coupled to said curtain rod hooks, said curtain rod being removably coupled to said curtain rod hooks;

a curtain for covering said main member and said side members, said curtain being slidably coupled to said curtain rod wherein said curtain can be slid to cover and uncover said main member and said side members;

a rod treatment curtain for covering said horizontal rod and connecting hooks, said rod treatment being coupled to said horizontal rod proximate said connecting hooks.

* * * * *